United States Patent [19]

Jeschke et al.

[11] Patent Number: 4,831,931

[45] Date of Patent: May 23, 1989

[54] DEVICE FOR TENSIONING A FLEXIBLE PRINTING PLATE ON A PLATE CYLINDER OF A ROTARY PRINTING MACHINE

[75] Inventors: Willi Jeschke, Bad Herrenalb; Lothar Stadler, Eppelheim, both of Fed. Rep. of Germany

[73] Assignee: Heidelberger Druckmaschinen Aktiengesellschaft, Heidelberg, Fed. Rep. of Germany

[21] Appl. No.: 233,584

[22] Filed: Aug. 18, 1988

[30] Foreign Application Priority Data

Aug. 25, 1987 [DE] Fed. Rep. of Germany ..... 3728263

[51] Int. Cl.[4] ..... B41F 27/12

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 3,903,796 | 9/1975 | Jeschke et al. | 101/415.1 |
| 4,596,188 | 6/1986 | Bonomi | 101/415.1 |
| 4,712,476 | 12/1987 | Jeschke | 101/415.1 |

FOREIGN PATENT DOCUMENTS

| | | |
|---|---|---|
| 2310228 | 3/1973 | Fed. Rep. of Germany . |
| 7219684 | 5/1974 | Fed. Rep. of Germany . |
| 2857614 | 2/1978 | Fed. Rep. of Germany . |
| 3222022 | 6/1982 | Fed. Rep. of Germany . |
| 3228244 | 7/1982 | Fed. Rep. of Germany . |
| 3606351 | 2/1986 | Fed. Rep. of Germany . |

*Primary Examiner*—Eugene H. Eickholt

*Attorney, Agent, or Firm*—Nils H. Ljungman

[57] ABSTRACT

A device for securing a flexible printing plate under tension on a plate cylinder is used in combination with the plate cylinder which has an axially extending channel with side walls formed therein. There is a tensioning rail operatively associated with each end of the printing plate. Each tensioning rail is braceable against one of the side walls of the axially extending channel formed in the plate cylinder for tensioning the printing plate. The device includes one of the tensioning rails operatively associated with at least one of the ends of the printing plate which is one-piece and has a central clamping member disposed at a middle region thereof for clamping a center of the one plate end. Respective tensioning strips are disposed at end regions of the tensioning rail. Each tensioning strip is mounted for axial movement on the tensioning rail and has an edge clamping member mounted thereon for clamping an edge of the one plate end. A selectively rotatable cam member is mounted on the tensioning rail and acts on the tensioning strip to produce selective axial movement of the tensioning strip in order to selectively stretch or compress the one plate end.

20 Claims, 4 Drawing Sheets

20
15
14
7
4
5
8
13
13
2
9
25
6
1
3

36
37
14
7
4
5
8
13
13
34
2
9
32
15
6
1
3

26
27
29
25
28
9

DEVICE FOR TENSIONING A FLEXIBLE PRINTING PLATE ON A PLATE CYLINDER OF A ROTARY PRINTING MACHINE

BACKGROUND OF THE INVENTION

1. Field of the Invention

This invention relates to an device for tensioning a flexible printing plate on a plate cylinder of a rotary printing machine with tensioning rails which are respectively located at each of the two ends of the plate and are braced against the side walls of a cylinder channel. For the trailing end of the plate, there is a one-piece tensioning rail. In the central portion of the trailing tensioning rail there is a clamping member for the end of the plate. In the outer regions of the trailing tensioning rail there are elements for stretching or compressing the trailing end of the plate in the axial direction of the plate cylinder.

2. Description of the Prior Art

Prior art plate cylinders have included tensioning rail configurations for providing tension to the leading and trailing end of a printing plate as an intermediate region of the printing plate extends about the cylindrical surface of the plate cylinder. Some such plate cylinders have also included means for relative stretching and contracting of the trailing end of the plate in an axial direction of the plate cylinder.

One such device is generally disclosed in U.S. Pat. No. 3,903,796, in which there are assigned to the trailing or rear end of the plate, two tensioning or gripping rail pairs which combine to support and locate the rear end of the printing plate by means of adjusting screws. These two tensioning rail pairs can be moved circumferentially in order to tension the printing plate as well as in an axial direction relative to the plate cylinder. Thus, it is possible to stretch the rear end of the plate, for example, in the case of the so-called "narrow printing", so that an exact register is obtainable. On the other hand, it is also possible to compress or contract the rear end. However, with the rear tensioning or gripping rail being divided it is difficult, in practical operation, to prevent the tensioning rail consisting of several sections from causing the printing plate to buckle.

Another such device is generally disclosed in U.S. Pat. No. 4,712,476, which corresponds to German Laid Open Patent Application No. P 36 06 351.7. This device includes tensioning rails operatively associated with both ends of the plate which are braceable against the side walls of a transverse or axial channel formed in the plate cylinder for tensioning of the printing plate. There is included an apparatus for selectively stretching and compressing at least one of the ends of the printing plate in an axial direction of the plate cylinder. The tensioning rail operatively associated with the one plate end is of a one-piece construction and has a clamping member which is disposed at a middle region thereof. Respective tensioning segments are disposed at the end regions of the tensioning rail and are actuable for stretching and/or compressing the one plate end. Specifically, the clamping elements for the outer edges of the one plate end include a pivotally mounted member having a circular clamping face for clamping the outer region between an axially slideable clamping backing element mounted on the tensioning rail. Pivotal movement of the clamping element is produced by some type of actuator which rotates the clamping element. Minor rotation of the clamping element moves the outer region of the one plate end and produces corresponding sliding movement of the clamping backing element.

Another device in U.S. Pat. No. 4,596,188 employs hydraulic piston means for moving and locating clamping devices therein. German Pat. No. DE-OS 32 28 244; DE-PS 28 57 614; DE-PS 32 22 022; and DE-GM 72 19 684 disclose other printing devices. These German Patents and U.S. Pat. Nos. 3,903,796; 4,596,188; and 4,712,476, are incorporated by reference as if included in their entirety herein.

OBJECT OF THE INVENTION

The object of the present invention is to provide a device for tensioning a flexible printing plate on a plate cylinder so that stretching or compressing (contracting) of the trailing end of the plate can be accomplished simply and effectively.

It is also an objective to be able to stretch or compress the trailing end of the plate with elements which are capable of precise and accurate control and are designed so that remote control adjustments are also possible during operation of the printing press.

SUMMARY OF THE INVENTION

These and other objects of the invention are provided in a preferred embodiment thereof including a device which is used in combination with a plate cylinder having an axially extending channel with side walls formed therein. The device is for securing a flexible printing plate under tension on the plate cylinder. A tensioning rail is operatively associated with each end of the printing plate and is braceable against the side walls of the axially extending channel formed in the plate cylinder for tensioning the printing plate. The device includes an apparatus for selectively stretching and/or compressing at least one of the ends of the printing plate in the axial direction of the plate cylinder. The tensioning rail which is operatively associated with the one plate end is of one-piece and has a central clamping member disposed at a middle region thereof for clamping a center of the plate end. The apparatus for selectively stretching and/or compressing includes respective tensioning strips disposed at end regions of the tensioning rail. Each tensioning strip is mounted for axial movement on the tensioning rail and has an edge clamping member mounted thereon for clamping an edge of the one plate end. The apparatus for selectively stretching and/or compressing includes mechanism for selective axial movement of the tensioning strip relative to the tensioning rail.

According to the invention, the tensioning strips are mounted on the trailing tensioning rail on both sides in the outer region so that they can be moved axially of the plate cylinder. An eccentric cam element is mounted on the tensioning rail to act upon the tensioning strip to produce the axial displacement of the tensioning strip. Some type of adjustment mechanism is employed to produce selective rotation of the cam element. A clamping member is movably guided on the tensioning strip, is displaced by means of an eccentric gripper cam mounted in the tensioning strip, and is aligned to press the end of the plate against a clamp surface on the tensioning strip to firmly clamp it.

The above-mentioned tensioning strips, to which the plate end is firmly clamped, can be axially adjusted with great precision and with a high control torque by means of the eccentric cam elements, so that the end of the plate can be very precisely stretched or compressed by means of a remote control. It should be understood that a mechanical or electrical activation of the adjustment mechanism is also possible.

BRIEF DESCRIPTION OF THE DRAWINGS

One embodiment of the invention is schematically illustrated in the accompanying figures.

DESCRIPTION OF THE PREFERRED EMBODIMENTS

Figure 1:
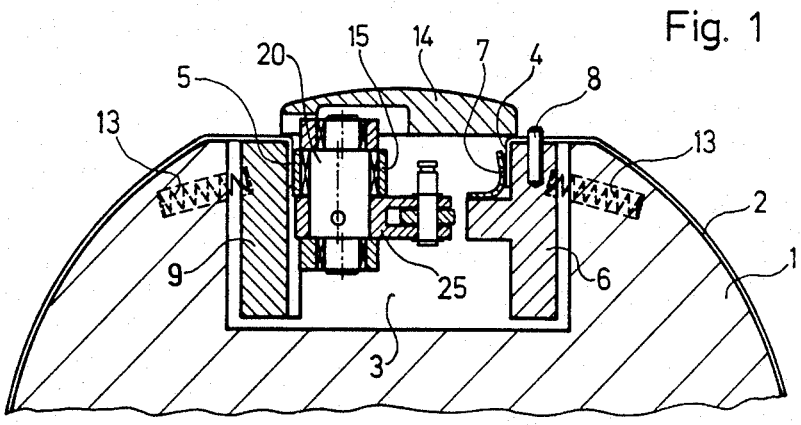
FIG. 1 is a fragmentary cross-sectional view of the device according to the invention, as seen along line 1—1 in FIG. 4.
Figure 2:
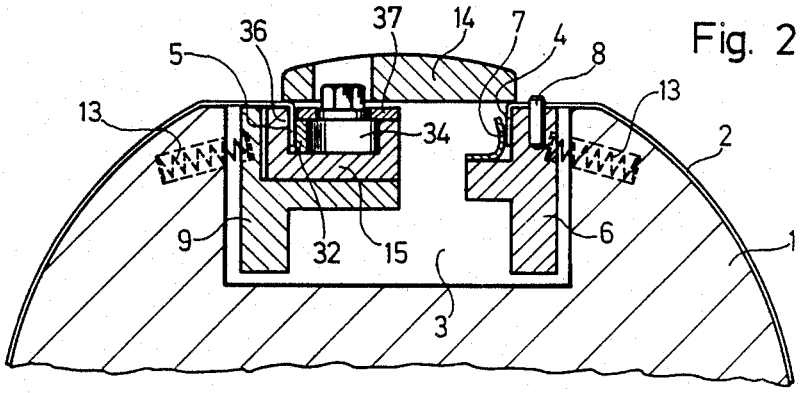
FIG. 2 is a fragmentary cross-sectional view as seen along line 2—2 in FIG. 4.

In the fragmentary cross-sectional view of FIG. 1, a plate cylinder 1 of a sheet-fed offset printing machine has, in a manner which is generally known in the prior art, a flexible printing plate 2 which is generally held in place by means of grippers or tensioning means. The tensioning means are located within a cylinder channel 3, which extends axially over the length of the cylinder body of the plate cylinder 1. The leading end 4 and the trailing end 5 of the plate are bent to a appropriate angle in a bending apparatus. The leading end 4 of the plate is secured to a tensioning rail 6 and is held in place by a spring 7. Locator or fitting pins 8 are provided for respective precise orientation of the leading end 4 and trailing end 5. As soon as the leading end 4 of the plate is gripped, the plate cylinder is rotated one revolution for mounting on the printing plate 2 so that the trailing end 5 of the plate can also be secured to a tensioning rail 9. The printing plate 2 is clamped or secured on the plate cylinder 1, so that the two tensioning rails 6 and 9 are respectively pivoted about pivotal pins (not shown) located in the lower region of each of the tensioning rails 6 and 9 into the positions shown in FIG. 1 by compression springs 13. The two ends 4 and 5 of the plate are located under a cover plate 14 which prevents them from slipping out.

Figure 4:
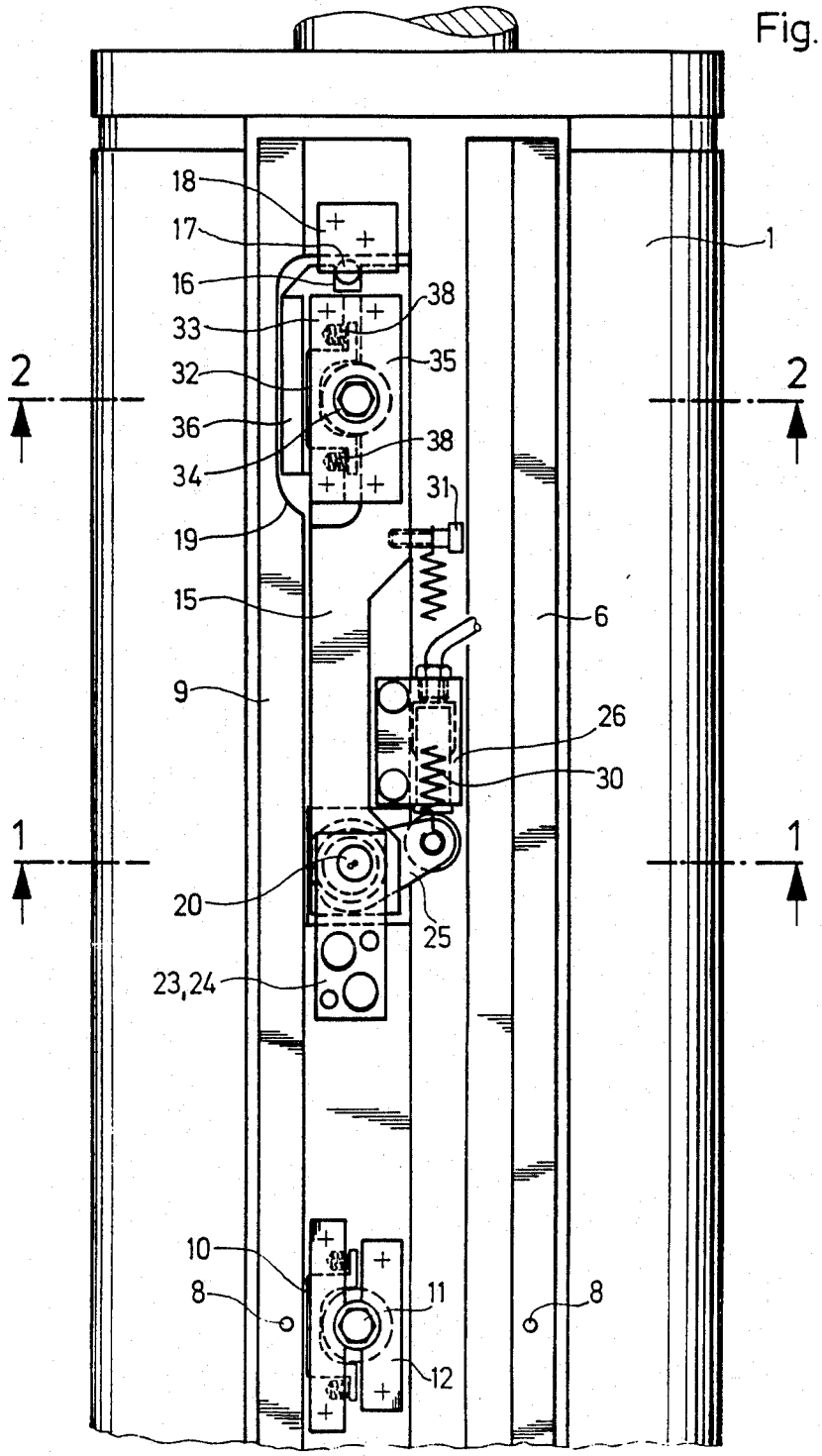
FIG. 4 is a plan view of the preferred gripper device in the plate cylinder.
Figure 5:
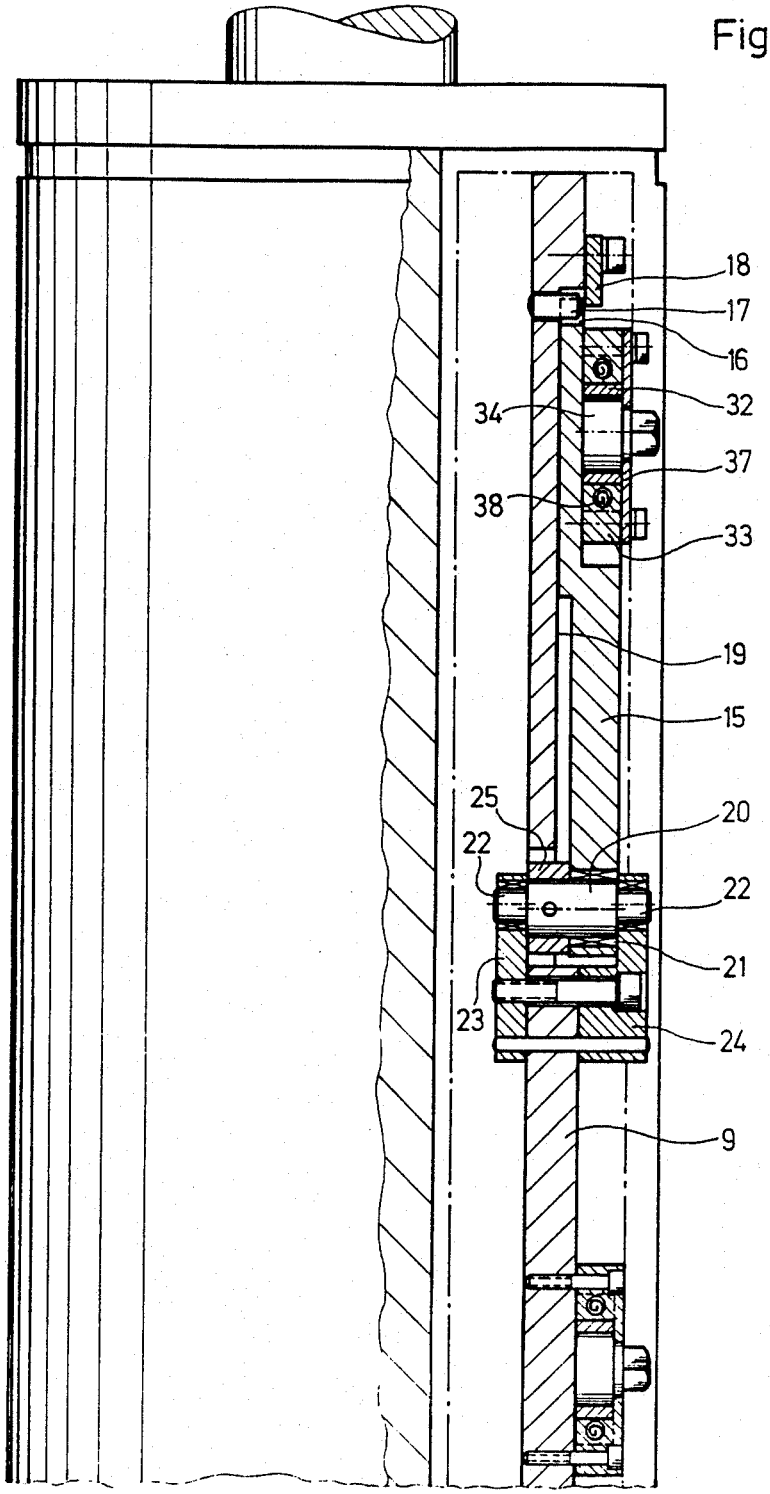
FIG. 5 is a fragmentary longitudinal cross-sectional view of the plate cylinder.

In the central region of the trailing tensioning rail 9, as shown in FIG. 4, a clamping member 10 can be moved against the angled or bent portion of the trailing end 5 of the plate. The tensioning rail 9 has a generally L-shaped cross-section with the clamping member 10 mounted on the lower or base portion thereof. The clamping member 10 tightly clamps the trailing end 5 against a clamping surface on the upwardly extending portion of the tensioning rail 9 under pressure created by selected rotation of a gripper cam 11. The gripper cam 11 is braced against a bearing 12 on the base portion of the tensioning rail 9. This ensures that the center of the trailing end 5 of the plate is properly located circumferentially and laterally upon the plate cylinder 1.

As mentioned above, it is desirable to include some means for gripping the flexible printing plate 2 while still allowing for lateral adjustment of the outer regions of the trailing end 5 of the plate. Generally, the clamping member 10 secures the central region both circumferentially and laterally upon the plate cylinder 1 and the means at the outer regions of the tensioning rail 9 should ensure proper circumferential location of the outer regions of the trailing end 5 of the plate. Accordingly, even though the outer regions of the trailing end 5 are circumferentially located, some means is provided according to the present invention for selective lateral movement of the outer regions of the trailing end 5 to produce the desired stretching or compressing of the trailing end 5 of the plate.

For this purpose, as seen in FIGS. 1, 2, 4 and 5, the preferred tensioning rail 9 includes a tensioning strip 15 in an outer region of the tensioning rail 9. Although only one tensioning strip 15 is shown in the figures, it should be recognized that a similar tensioning strip 15 is located at the opposite outer region of the tensioning rail 9. Accordingly, corresponding or individual movement of the tensioning strips 15, as explained hereinbelow, is possible for selective stretching or compressing of each outer region of the trailing end 5 of the plate. Each tensioning strip 15 is basically mounted to and supported by the base portion of the tensioning rail 9 so that it can be moved longitudinally in an axial direction relative to the plate cylinder 1 and the tensioning rail 9. The outer end of the tensioning strip 15 is provided a guide groove 16, in which a guide pin 17 is engaged. The tensioning strip 15 is generally held against the base portion of the tensioning rail 9 by a cover plate 18. Although portions of the tensioning strip 15 may extend into and move within a recess 19 in the tensioning rail 9, the overall tensioning strip 15 is supported by and axially slides upon the upper surface of the base portion of the tensioning rail 9.

Figure 3:
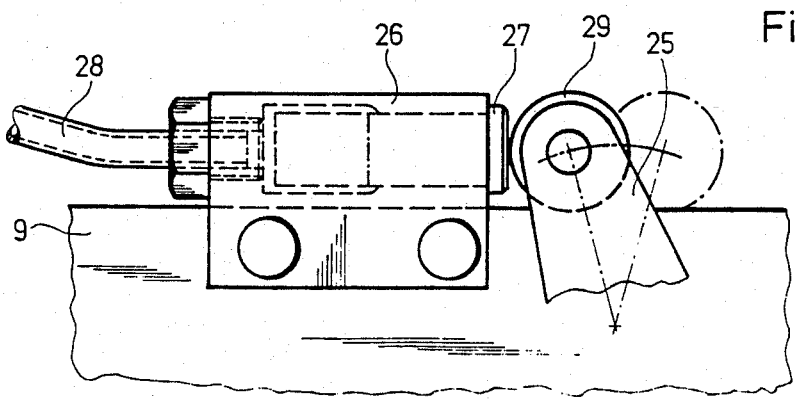
FIG. 3 is a fragmentary plan view of the preferred gripper device.

To produce axial movement of each tensioning strip 15, there is provided an eccentric circular cam element 20, which includes the circular camming surface thereof mounted for rotation within needle bearing means at the end of the tensioning strip 15 toward the center of the plate cylinder 1. Two support pins 22 of the eccentric cam element 20 are mounted in bearings 23, 24, which are in turn fastened to the tensioning rail 9. Rotation about the pins 22 produces a camming action by the cam element 20 within the bearing means to produce axial movement of the tensioning strip 15. To rotate the eccentric circular cam element 20, a forked lever 25, as shown in FIG. 3, serves as an actuator arm secured to the cam element 20. In the preferred embodiment, it is activated by a hydraulic cylinder 26. In the hydraulic cylinder 26 there is provided a piston 27 which, as soon as a hydraulic pressure medium is introduced via the hydraulic line 28, moves axially to extend from the cylinder 26 as the outer end thereof acts upon a roller 28 (shown in FIGS. 3 and 4) to pivot the forked lever 25. By a controlled supply or release of the hydraulic medium, a precise and continuous pivoting of the forked lever 25 and thus of the eccentric cam element 20 can be achieved. As a result, the tensioning strip 15 can be moved with very slight displacements in the longitudinal or axial direction. The hydraulic cylinder 26 is fastened to the base portion of the tensioning rail 9.

When there is a release of hydraulic medium or a reduction of pressure in the hydraulic line 28, a tension spring 30 would retract the piston 27. The tension spring 30 includes one end which is secured to a screw 31 fastened to the tensioning strip 15 and an another end secured to the forked lever 25. The spring 30 would normally be under tension to ensure that the roller 28 is held against the piston 27 and to produce biasing against the outward movement of the piston 27. Additionally, the spring 30 would bias the tensioning strip 15 toward the eccentric circular cam element 20 and tend to ensure positive contact therebetween.

To be able to stretch or compress the trailing end 5 of the plate, according to the present invention, positive clamping or gripping of the outer regions of the trailing end 5 is required. For this purpose, a clamping member 32 is mounted on the tensioning strip 15 for guided movement within a mounting 33. Rotation of the eccentric gripper cam 34 mounted on the tensioning strip 15 by means of a bearing 35 makes it possible to clamp the outer region of the trailing end 5 of the plate to a clamping surface 36 of the tensioning strip 15. The clamping member 32 and the eccentric gripper cam 34 are held in place by means of a cover 37. To retract the clamping member 32 in order to facilitate the introduction of the trailing end 5 of each new plate, there are two compression springs 38 in the mounting 33. Since the tensioning strips 15 are mounted to only move axially relative the tensioning rail 9, proper axial alignment of the two clamping surfaces 36 with the clamping surface of the upwardly extending portion of the tensioning rail 9 at the clamping member 10 ensures that the entire length of the trailing end 5 will be properly located circumferentially on the plate cylinder 1. After the trailing end 5 of the plate is clamped tightly at each side of the tensioning rail 9 by the clamping member 32 after turning the eccentric gripper cam 34 thereof, the forked lever 25 and the eccentric cam element 20 on which it is mounted can be rotated by means of the hydraulic cylinder 26 and the piston 27. The tensioning strip 15 is thereby moved in the axial direction, so that an outward movement caused by controlled, selective extension of the piston 27 will cause the trailing end 5 of the plate to be stretched. Movement toward the center of the plate cylinder 1, which is generally produced by the spring 30, results in a compression or contraction of the trailing end 5 of the printing plate. The amount of the stretching or contracting of the trailing end 5 of the plate is determined according to the required correction of the printed image. Normally, such corrections are made by a small amount of axial movement produced uniformly at both sides of the printing plate. Because of the central clamping by means of the clamping member 10, a one-sided adjustment of the tensioning strip 15 and therefore of the trailing end 5 of the printing plate can also be achieved.

Figure 6:
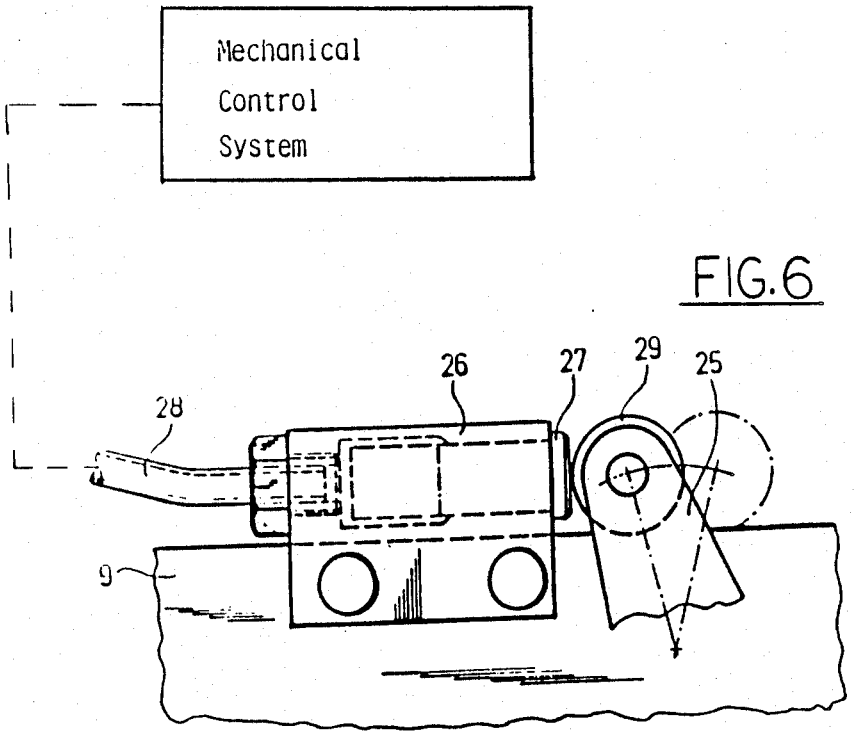
FIG. 6 is a fragmentary plan view of the device of FIG. 3 including additional features of the invention.

As seen in FIG. 6, the hydraulic medium for introduction into and evacuation from the interior of the hydraulic cylinder 26 can be controlled and operated through means which is physically remote from the location of the plate cylinder 1.

Figure 7:
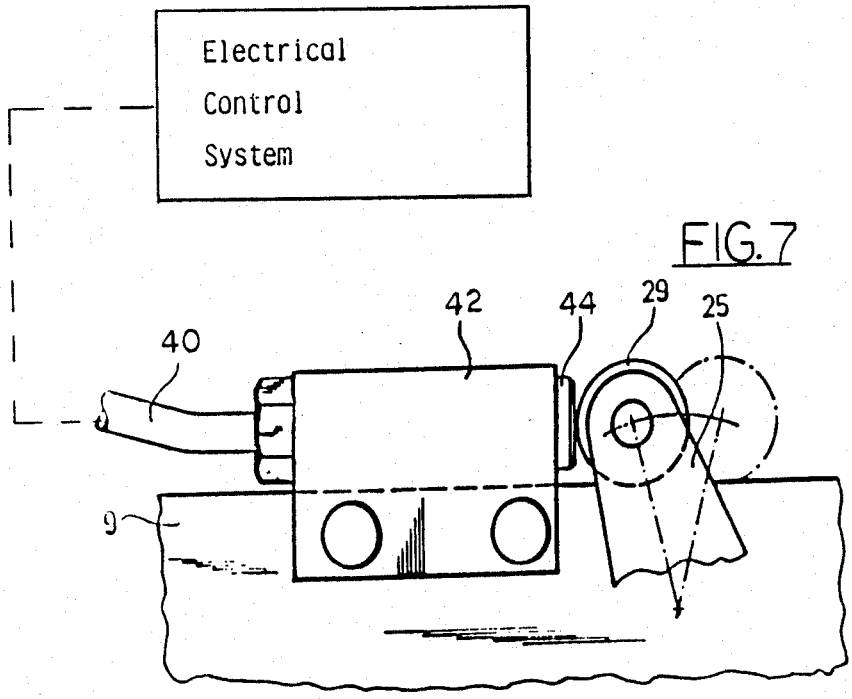
FIG. 7 is a fragmentary plan view similar to that of FIG. 6 including an alternative embodiment of the invention.

Similarly, as seen in FIG. 7, means remote from the plate cylinder 1, in the form of an electrical control system and circuitry, can be employed to provide operating electrical signals to an alternative means for moving and positioning the fork lever 25. The electrical signals would be delivered through wiring 40 to an adjusting motor or servomotor 42 which is mounted on the tensioning rail 9. Proper electrical control signals to the servomotor 42 would produce desired linear movement of an armature element 44 mounted for axial movement within the servomotor 42. The armature element 44 would again act upon the fork lever 25 through a roller 29 in a similar manner as produced by the hydraulic cylinder 26 and piston 27. However, with such a configuration employing the servomotor 42 and armature element 44, it might be possible to eliminate positive biasing by the spring 30 since such a system might be better able to produce controlled positioning of the fork lever 25. Although some biasing or some other means may be employed to ensure contact will be maintained between the armature element 44 and the roller 29, overall positive biasing may not be required for the specific positioning of the forked lever 25.

It should be clear that either mechanical or electrical activation, such as by a hydraulic fluid medium or electrical control signals, can be used to activate the adjustment means from a position which is remote from the plate cylinder 1. Those skilled in the art of printing presses will recognize that there are existing, well-known means for providing hydraulic or electrical signals to elements located on rotating plate cylinders so that the desired control or signaling can be produced during operation of the plate cylinder. Accordingly, it should be clear from the embodiments described hereinabove that the preferred tensioning strips can be axially adjusted with great precision and with high control torque by means of the eccentric circular cam elements so that the end of the plate can be very precisely stretched or compressed by means that is controlled remotely of the plate cylinder 1. Nevertheless, it should be recognized that other alternative remotely controlled adjusting means could be employed without departing from the scope of the invention as claimed to produce the desired axial movement of each of the tensioning strips relative to the tensioning rail.

The invention as described hereinabove in the context of a preferred embodiment is not to be taken as limited to all of the provided details thereof, since modifications and variations thereof may be made without departing from the spirit and scope of the invention.

What is claimed is:

1. In combination with a plate cylinder having an axially extending channel with side walls formed therein, a device for securing a flexible printing plate under tension on said plate cylinder, a tensioning rail operatively associated with each end of said printing plate and being braceable against one of said side walls of said axially extending channel formed in said plate cylinder for tensioning said printing plate, said device comprising:

means for selectively stretching and/or compressing at least one of said ends of said printing plate in the axial direction of said plate cylinder;

said tensioning rail operatively associated with said one plate end being of one-piece and having a central clamping member disposed at a middle region thereof for clamping a center of said one plate end;

said means for selectively stretching and/or compressing including respective tensioning strips disposed at end regions of said tensioning rail;

said tensioning strip being mounted for axial movement on said tensioning rail;

said tensioning strip having an edge clamping member mounted thereon for clamping an edge of said one plate end; and said means for selectively stretching and/or compressing including means for selective axial movement of said tensioning strip relative to said tensioning rail.

2. The device according to claim 1, wherein said means for selective axial movement includes selective rotation of cam means mounted on said tensioning rail and acting on said tensioning strip.

3. The device according to claim 2, wherein said cam means includes an actuator arm ridigly mounted thereon and said selective rotation of said cam means includes selective positioning of said actuator arm.

4. The device according to claim 3, wherein said selective rotation of said cam means includes selective actuation of a linear adjuster having a relatively movable output member, said output member is operatively coupled to an extended end of said actuator arm for corresponding movement thereof, and said selective actuation of said linear adjuster produces movement of said output member and said extended end of said actuator arm for said selective positioning thereof.

5. The device according to claim 4, wherein said linear adjustor includes a hydraulic cylinder and said output member includes a piston element mounted within said hydraulic cylinder.

6. The device according to claim 5, further including mechanical control means for controlling said selective actuation of said hydraulic cylinder and said piston element at a location which is remote from said plate cylinder.

7. The device according to claim 4, wherein said linear adjuster includes a servomotor and said output member includes the armature element of said servomotor.

8. The device according to claim 7, further including electrical control means for said selective actuation of said servomotor and said armature element at a location which is remote from said plate cylinder.

9. The device according to claim 4, further including biasing means acting on said actuator arm in opposition to said linear adjuster.

10. The device according to claim 4, wherein said output member moves in a direction for extension from said linear adjuster to produce said stretching of said one plate end.

11. The device according to claim 10, further including biasing means acting on said actuator arm in opposition to said extension of said output member from said linear adjuster.

12. The device according to claim 11, wherein said biasing means includes a spring having one end secured to said extended end of said actuator arm and another end secured to said tensioning strip.

13. The device according to claim 10, wherein said spring is under tension.

14. A device for securing a flexible printing plate under tension on a plate cylinder, wherein said plate cylinder has an axially extending channel with side walls formed therein, a tensioning rail is operatively associated with each end of said printing plate and is braceable against one of said side walls of said axially extending channel formed in said plate cylinder for tensioning said printing plate, said device comprising:

said tensioning rail operatively associated with at least one of said ends of said printing plate being of one-piece and having a central clamping member disposed at a middle region thereof for clamping a center of said one plate end;

a tensioning strip disposed at each of the end regions of said tensioning rail;

said tensioning strip being mounted for axial movement on said tensioning rail;

said tensioning strip having an edge clamping member mounted thereon for clamping an edge of said one plate end; and means for selectively stretching and/or compressing said one plate end in the axial direction of said plate cylinder including means for selective axial positioning of said tensioning strip relative to said tensioning rail.

15. The device according to claim 14, wherein said means for selective axial positioning includes selective rotation of cam means mounted on said tensioning rail and acting on said tensioning strip.

16. The device according to claim 15, wherein said cam means includes an actuator arm rigidly mounted thereon and said selective rotation of said cam means includes selective positioning of said actuator arm.

17. The device according to claim 16, wherein said selective rotation of said cam means includes selective actuation of a linear adjuster having a relatively movable output member, said output member is operatively coupled to an extended end of said actuator arm for corresponding movement thereof, and said selective actuation of said linear adjuster produces movement of said output member and said extended end of said actuator arm for said selective positioning thereof.

18. The device according to claim 17, wherein said linear adjustor includes a hydraulic cylinder and said output member includes a piston element mounted within said hydraulic cylinder.

19. The device according to claim 17, further including biasing means acting on said actuator arm in opposition to said linear adjuster.

20. The device according to claim 17, wherein said output member moves in a direction for extension from said linear adjuster to produce said stretching of said one plate end.

* * * * *